US009068317B2

(12) United States Patent
Reinhall et al.

(10) Patent No.: US 9,068,317 B2
(45) **Date of Patent: *Jun. 30, 2015**

(54) PILE WITH LOW NOISE GENERATION DURING DRIVING

(71) Applicant: University of Washington through its Center for Commercialization, Seattle, WA (US)

(72) Inventors: Per G. Reinhall, Seattle, WA (US); Peter H. Dahl, Seattle, WA (US); John Timothy Dardis, II, Seattle, WA (US)

(73) Assignee: University of Washington through its Center for Commercialization, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/113,578

(22) PCT Filed: Nov. 2, 2012

(86) PCT No.: PCT/US2012/063430

§ 371 (c)(1),
(2) Date: Oct. 23, 2013

(87) PCT Pub. No.: WO2013/067438

PCT Pub. Date: May 10, 2013

(65) Prior Publication Data

US 2014/0056650 A1 Feb. 27, 2014

Related U.S. Application Data

(60) Provisional application No. 61/555,336, filed on Nov. 3, 2011.

(51) Int. Cl.
*E02D 5/24* (2006.01)
*E02D 5/72* (2006.01)
(Continued)

(52) U.S. Cl.
CPC .. *E02D 5/24* (2013.01); *E02D 5/30* (2013.01); *E02D 7/02* (2013.01); *E02D 5/72* (2013.01)

(58) Field of Classification Search
CPC ..... E02D 5/22; E02D 5/30; E02D 5/72; E02D 7/02
USPC ..... 405/231, 232, 245, 246, 249, 253, 254
See application file for complete search history.

(56) References Cited

U.S. PATENT DOCUMENTS 790,910 A * 5/1905 McClintock ..... 405/245
2,972,871 A 1/1957 Foley, Jr.
(Continued)

FOREIGN PATENT DOCUMENTS

JP 62-170612 B2 7/1987
JP 07-286324 A 10/1995
(Continued)

OTHER PUBLICATIONS

International Search Report and Written Opinion mailed Aug. 3, 2011, issued in corresponding International Application No. PCT/US2011/021723, filed Jan. 19, 2011, 7 pages.

*Primary Examiner* — Frederick L Lagman
(74) *Attorney, Agent, or Firm* — Christensen O'Connor Johnson Kindness PLLC

(57) ABSTRACT

A pile (300) with a effective low Poisson's ratio is disclosed, which greatly reduces the sound coupling to the water and sediment or other ground when driving piles. The pile includes a plurality of geometric features that reduce the radial amplitude of the compression wave generated by hammering the pile by providing a space for circumferential expansion along the length of the pile. In various embodiments, the geometric features comprise slots (303) and/or grooves (313, 323). In an embodiment, a driving shoe (316, 316) has a perimeter that extends beyond the pile tube such that the sediment produces less of a binding force on the pile. The pile may be formed as a double-shelled pile (310) with either or both shells having effective low Poisson's ratio properties. A bubble generating plenum (328) may be attached to the shoe to further reduce friction during installation.

14 Claims, 10 Drawing Sheets

(51) Int. Cl.
*E02D 7/02* (2006.01)
*E02D 5/30* (2006.01)

(56) References Cited

U.S. PATENT DOCUMENTS

| | | | | | |
|---|---|---|---|---|---|
| 3,261,412 | A | * | 7/1966 | Lob | 405/253 |
| 3,779,025 | A | * | 12/1973 | Godley et al. | 405/249 |
| 4,808,037 | A | | 2/1989 | Wade | |
| 4,817,734 | A | | 4/1989 | Kuehn | |
| 5,282,701 | A | | 2/1994 | An | |
| 5,320,453 | A | * | 6/1994 | Bullivant | 405/239 |
| 5,494,378 | A | * | 2/1996 | Hanson | 405/244 |
| 6,042,304 | A | | 3/2000 | Manning | |
| 6,047,505 | A | * | 4/2000 | Willow | 405/253 |
| 6,123,485 | A | * | 9/2000 | Mirmiran et al. | 405/252 |
| 6,264,403 | B1 | * | 7/2001 | Hall et al. | 405/252.1 |
| 6,354,766 | B1 | | 3/2002 | Fox | |
| 6,409,433 | B1 | * | 6/2002 | Hubbell et al. | 405/250 |
| 6,568,881 | B2 | * | 5/2003 | Long | 405/248 |
| 7,037,045 | B2 | * | 5/2006 | Jones | 405/252.1 |
| 7,226,247 | B2 | * | 6/2007 | Barrett et al. | 405/232 |
| 7,338,233 | B2 | * | 3/2008 | Barrett et al. | 405/244 |
| 7,517,174 | B2 | * | 4/2009 | Wolynski et al. | 405/249 |
| 8,622,658 | B2 | * | 1/2014 | Reinhall et al. | 405/228 |
| 2002/0159843 | A1 | * | 10/2002 | Hubbell et al. | 405/231 |
| 2003/0082012 | A1 | * | 5/2003 | Clark | 405/249 |
| 2009/0110488 | A1 | * | 4/2009 | Pearson | 405/251 |
| 2013/0011203 | A1 | * | 1/2013 | Reinhall et al. | 405/228 |
| 2014/0086693 | A1 | * | 3/2014 | Reinhall et al. | 405/249 |

FOREIGN PATENT DOCUMENTS

| | | | |
|---|---|---|---|
| JP | 08-260499 | A | 10/1996 |
| KR | 10-0543727 | B1 | 1/2006 |
| KR | 10-0657176 | B1 | 12/2006 |
| KR | 10-0841735 | B1 | 6/2008 |
| WO | 2004053237 | B1 | 6/2004 |
| WO | 2011-091041 | A2 | 7/2011 |

* cited by examiner

PILE WITH LOW NOISE GENERATION DURING DRIVING

BACKGROUND

Pile driving in water produces extremely high sound levels in the surrounding environment in air and underwater. For example, underwater sound levels as high as 220 dB re 1 μPa are not uncommon ten meters away from a steel pile as it is driven into the sediment with an impact hammer.

Reported impacts on wildlife around a construction site include fish mortality associated with barotrauma, hearing impacts in both fish and marine mammals, and bird habitat disturbance. Pile driving in water is therefore a highly regulated construction process and can only be undertaken at certain time periods during the year. The regulations are now strict enough that they can severely delay or prevent major construction projects.

There is thus significant interest in reducing underwater noise from pile driving either by attenuating the radiated noise or by decreasing noise radiation from the pile. As a first step in this process, it is necessary to understand the dynamics of the pile and the coupling with the water as the pile is driven into sediment. The process is a highly transient one, in that every strike of the pile driving hammer on the pile causes the propagation of deformation waves down the pile. To gain an understanding of the sound generating mechanism, the present inventors have conducted a detailed transient wave propagation analysis of a submerged pile using finite element techniques. The conclusions drawn from the simulation are largely verified by a comparison with measured data obtained during a full scale pile driving test carried out by the University of Washington, the Washington State Dept. of Transportation, and Washington State Ferries at the Vashon Island ferry terminal in November 2009.

Prior art efforts to mitigate the propagation of dangerous sound pressure levels in water from pile driving have included the installation of sound abatement structures in the water surrounding the piles. For example, in *Underwater Sound Levels Associated With Pile Driving During the Anacortes Ferry Terminal Dolphin Replacement Project*, Tim Sexton, Underwater Noise Technical Report, Apr. 9, 2007 ("Sexton"), a test of sound abatement using bubble curtains to surround the pile during installation is discussed. A bubble curtain is a system that produced bubbles in a deliberate arrangement in water. For example, a hoop-shaped perforated tube may be provided on the seabed surrounding the pile, and provided with a pressurized air source, to release air bubbles near or at the sediment surface to produce a rising sheet of bubbles that act as a barrier in the water. Although significant sound level reductions were achieved, the pile driving operation still produced high sound levels.

Another method for mitigating noise levels from pile driving is described in a master's thesis by D. Zhou entitled *Investigation of the Performance of a Method to Reduce Pile Driving Generated Underwater Noise* (University of Washington, 2009). Zhou describes and models a noise mitigation apparatus dubbed Temporary Noise Attenuation Pile (TNAP) wherein a steel pipe is placed about a pile before driving the pile into place. The TNAP is hollow-walled and extends from the seabed to above the water surface. In a particular apparatus disclosed in Zhou, the TNAP pipe is placed about a pile having a 36-inch outside diameter (O.D.). The TNAP pipe has an inner wall with a 48-inch O.D., and an outer wall with a 54-inch O.D. A 2-inch annular air gap separates the inner wall from the outer wall.

Although the TNAP did reduce the sound levels transmitted through the water, not all criteria for noise reduction were achieved.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A pile configured to produce lower noise levels during installation includes a driving shoe, and an elongate tube that is configured to have an low effective Poisson's ratio such that the amplitude of longitudinal radial expansion waves resulting from hammering or driving the pile into the ground are substantially prevented from being transmitted into the ground. The tube may have a circular or a non-circular cross section.

A pile configured for noise abasement includes a driving shoe and a tube or rod with a distal end that engages the driving shoe and a proximal end that is configured to be driven with a pile driver. The tube incorporates geometric features, for example, longitudinal slots, and/or longitudinal grooves on the inner and/or outer surface of the tube, that attenuate the radial amplitude of traveling compression waves by providing space for circumferential expansion. The longitudinal features may be aligned with the axis of the tube, and may be provided intermittently. In an embodiment, the intermittent slots or grooves are offset. In another particular embodiment, grooves are provided on both the inner and outer surfaces of the tube.

In an embodiment, the pile further comprises a second tube disposed radially outwardly from the first tube, with a gap therebetween. The first tube is configured to be driven, for example, by extending upwardly beyond the second tube. The tubes may be circular and concentric, and the gap may define an annular tubular space. In an embodiment, the annular tubular space is partially or substantially filled with a compressible filler, for example, a polymeric foam. The filler may have linear or non-linear deformation characteristics. In an embodiment, the second tube is fixed to the drive shoe and configured to be pulled into the ground by the drive shoe, which is driven into the ground through the first tube.

In an embodiment, the first tube is removably attached to the drive shoe and is configured to be removed after driving in the pile, such that the first tube functions as a mandrel.

In an embodiment, the drive shoe extends radially outwardly from the first tube, and if present, the second tube, thereby reducing the coupling between the ground and the tube. In an embodiment, the drive shoe defines a radially outward ledge, and the pile further comprises an annular plenum with a plurality of apertures and connected to a high pressure air source, wherein the plenum is disposed on the ledge that is thereby driven into the ground with the drive shoe. The plenum is configured to generate bubbles during the driving process, further decoupling the tube from the ground.

A method for driving piles into the ground includes providing a pile, for example, a pile as described above, configured to attenuate the radial amplitude of traveling compression waves, positioning the pile at a desired position, and driving the pile with a pile driver.

In an embodiment, the pile is configured with geometric features that encourage circumferential expansion in the elongate tube, for example, a plurality of longitudinal slots or grooves, which may be intermittent and offset.

In an embodiment, the pile further is formed in a double-shell configuration, defining an annular space between first and second tubes. The annular space may be partially filled with an elastic material, for example, a polymeric foam. In an embodiment, the inner tube is removed after driving in the pile.

In an embodiment, the drive shoe extends radially outward from the tube(s) defining a ledge. A bubble generator may be disposed on the ledge to generate a bubble curtain adjacent the pile while driving the pile.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
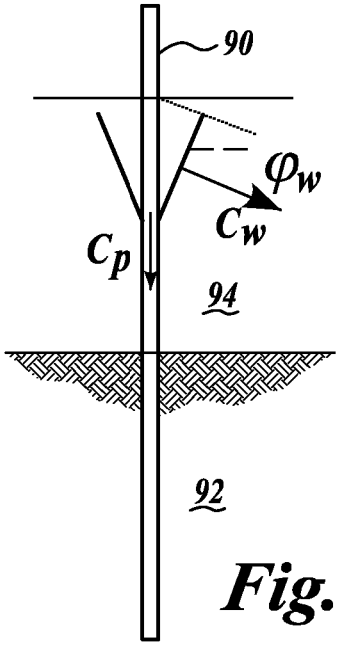
FIGS. 1A-1D illustrate the primary wave fronts associated with a Mach cone generated by a representative pile compression wave.

To investigate the acoustic radiation due to a pile strike, an axisymmetric finite element model of a 30-inch (0.762 m) radius, 32 m long hollow steel pile with a wall thickness of one inch submerged in 12.5 m of water was created and modeled as driven 14 m into the sediment. The radius of the water and sediment domain was 10 m. Perfectly matched boundary conditions were used to prevent reflections from the boundaries that truncate the water and sediment domains. The pile was fluid loaded via interaction between the water/sediment. All domains were meshed using quadratic Lagrange elements.

The pile was impacted with a pile hammer with a mass of 6,200 kg that was raised to a height of 2.9 m above the top of the pile. The velocity at impact was 7.5 m/s, and the impact pressure as a function of time after impact was examined using finite element analysis and approximated as:

$$P(t)=2.7*10^8 \exp(-t/0.004)\text{Pa} \quad (1)$$

The acoustic medium was modeled as a fluid using measured water sound speed at the test site, $c_w$, and estimated sediment sound speed, $c_s$, of 1485 m/s and 1625 m/s, respectively. The sediment speed was estimated using coring data metrics obtained at the site, which is characterized by fine sand, and applied to empirical equations.

The present inventors conducted experiments to measure underwater noise from pile driving at the Washington State Ferries terminal at Vashon Island, Wash., during a regular construction project. The piles were approximately 32 m long and were set in 10.5 to 12.5 m of water, depending on tidal range. The underwater sound was monitored using a vertical line array consisting of nine hydrophones with vertical spacing of 0.7 m, and the lowest hydrophone placed 2 m from the bottom. The array was set such that the distance from the piles ranged from 8 to 12 m.

Pressure time series recorded by two hydrophones located about 8 m from the pile showed the following key features:

1. The first and highest amplitude arrival is a negative pressure wave of the order 10-100 kPa;
2. The main pulse duration is ~20 ms over which there are fluctuations of 10 dB; during the next 40 ms the level is reduced by 20 dB; and
3. There are clearly observable time lags between measurements made at different heights off the bottom. These time lags can be associated with the vertical arrival angle.

The finite element analysis shows that the generation of underwater noise during pile driving is due to a radial expansion wave that propagates along the pile after impact. This structural wave produces a Mach cone in the water and the sediment. An upward moving Mach cone produced in the sediment after the first reflection of the structural wave results in a wave front that is transmitted into the water. The repeated reflections of the structural wave cause upward and downward moving Mach cones in the water. The corresponding acoustic field consists of wave fronts with alternating positive and negative angles. Good agreement was obtained between a finite element wave propagation model and measurements taken during full scale pile driving in terms of angle of arrival. Furthermore, this angle appears insensitive to range for the 8 to 12 m ranges measured, which is consistent with the wave front being akin to a plane wave.

The primary source of underwater sound originating from pile driving is associated with compression of the pile. Refer to FIGS. 1A-1D, which illustrate schematically the transient behavior of the reactions associated with an impact of a pile driver (not shown) with a pile 90. In FIG. 1A, the compression wave in the pile 90 due to the hammer strike produces an associated radial displacement motion due to the effect of Poisson's ratio of steel (typically about 0.27-0.33). This radial displacement in the pile 90 propagates downwards (indicated by downward arrow) with the longitudinal wave with a wave speed of $c_p$=4,840 m/s when the pile 90 is surrounded by water 94. Because the wave speed of this radial displacement wave is higher than the speed of sound in the water 94, the rapidly downward propagating wave produces an acoustic field in the water 94 in the shape of an axisymmetric cone (Mach cone) with apex traveling along with the pile deformation wave front. This Mach cone is formed with cone angle of $\phi_w=\sin^{-1}(c_w/c_p)=17.9°$.

Figure 1B:
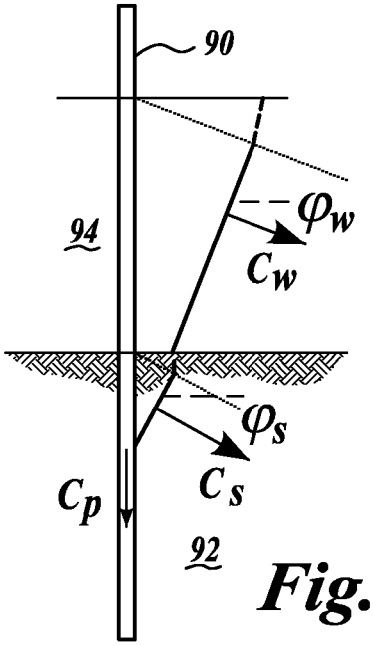

Note that this is the angle formed between the vertically oriented pile 90 and the wave front associated with the Mach cone; it is measured with a vertical line array, and here it will be manifested as a vertical arrival angle with reference to horizontal. This angle only depends on the two wave speeds and is independent of the distance from the pile. As illustrated in FIG. 1B, the Mach cone angle changes from $\phi_w$ to $\phi_s=\sin^{-1}(c_w/c_p)=19.7°$ as the pile bulge wave enters sediment 92. Note that the pile bulge wave speed in the sediment 92 is slightly lower due to the higher mass loading of the sediment 92 and is equal to $c_p$=4,815 m/s.

Figure 1C:
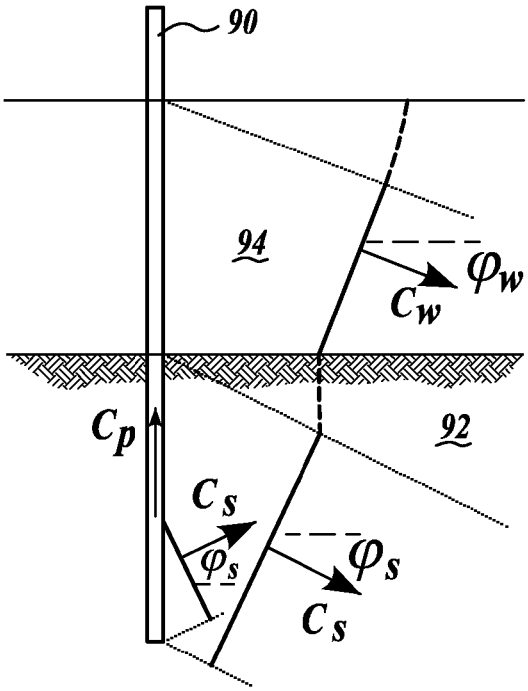
Figure 1D:
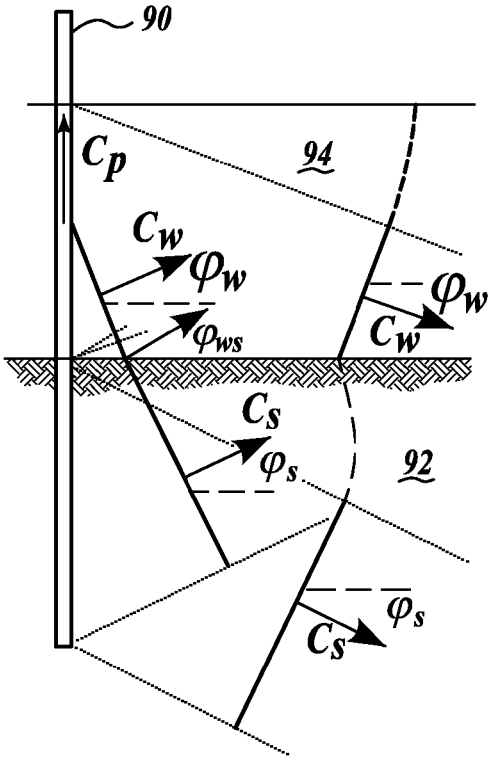
Figure 2:
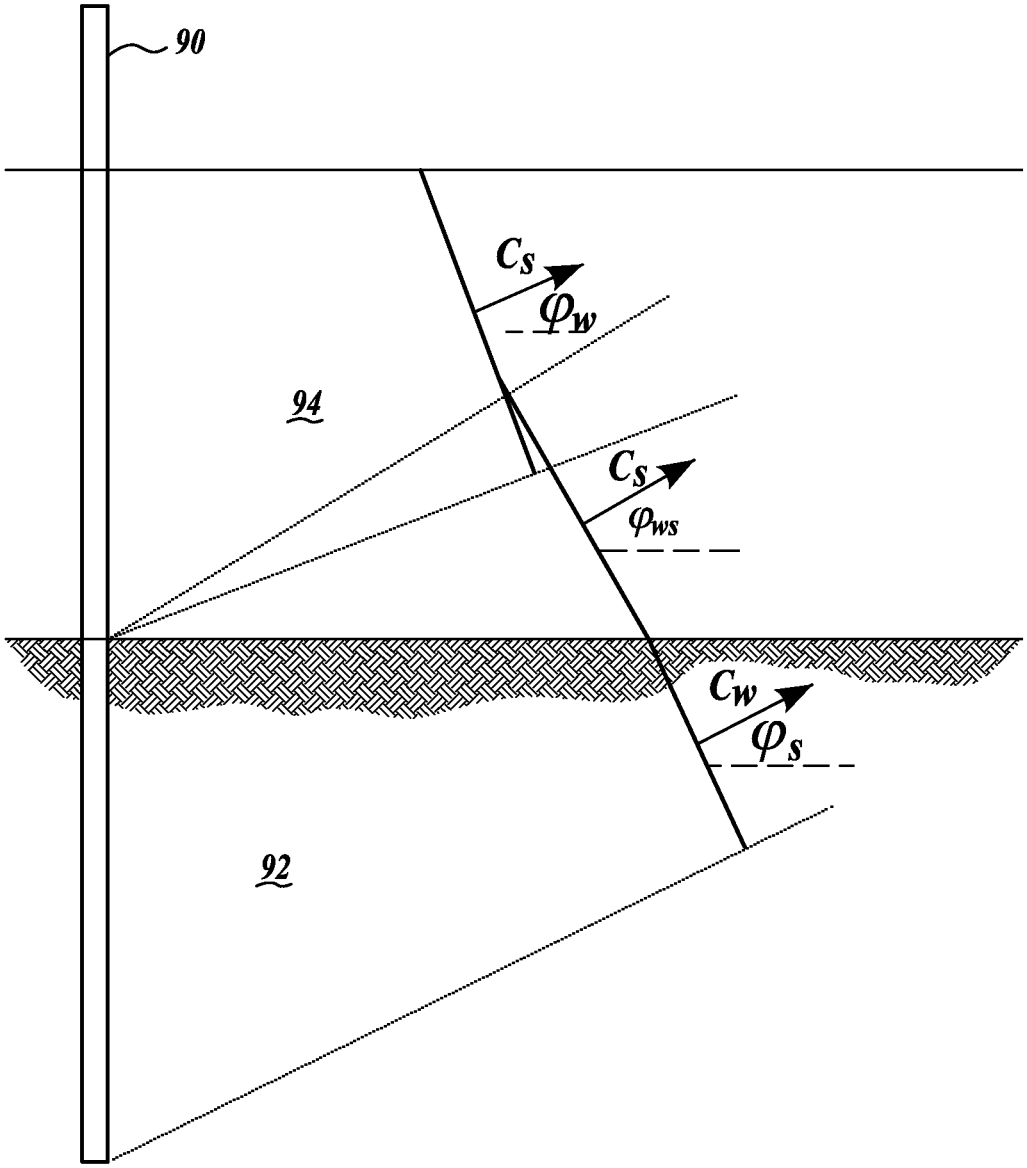
FIG. 2 illustrates a first upwardly traveling wave front for the representative pile compression wave illustrated in FIGS. 1A-1D.

As the wave in the pile reaches the pile 90 terminal end, it is reflected upwards (FIG. 1C). This upward traveling wave in turn produces a Mach cone of angle $\phi$, (defined as negative with respect to horizontal) that is traveling up instead of down. The sound field associated with this cone propagates up through the sediment 92 and penetrates into the water 94. Due to the change in the speed of sound going from sediment 92 to water 94, the angle of the wave front that originates in the sediment 92 changes from $\phi_s$ to $\phi_{sw}$=30.6° following Snell's law. Ultimately, two upward moving wave fronts occur, as shown schematically in FIG. 1D and more clearly in FIG. 2. One wave front is oriented with angle $\phi_{sw}$ and the other wave front with angle $\phi_{ws}$. The latter is produced directly by the upward moving pile wave front in the water 94. (Other features of propagation such as diffraction and multiple reflections are not depicted in these schematic illustrations, for clarity.)

Based on finite element analyses performed to model the transient wave behavior generated from impacts generated when driving a pile 90, the generation of underwater noise during pile 90 driving is believed to be due to a radial expansion wave that propagates along the pile after impact. This structural wave produces a Mach cone in the water and the sediment. An upwardly moving Mach cone produced in the sediment after the first reflection of the structural wave results in a wave front that is transmitted into the water. Repeated reflections of the structural wave causes upward and downward moving Mach cones in the water.

It is believed that prior art noise attenuation devices, such as bubble curtains and the TNAP discussed above, have limited effectiveness in attenuating sound levels transmitted into the water because these prior art devices do not address sound transmission through the sediment. As illustrated most clearly in FIG. 2, an upwardly traveling wave front propagates through the sediment 92 with a sound speed $c_w$. This wave front may enter the water outside of the enclosure defined by any temporary barrier, such as a bubble curtain or TNAP system, for example, such that the temporary barrier will have little effect on this component of the sound.

The important aspect of the sound generation mechanism described above is that a significant source of the sound is transmitted from the sediment to the water. Therefore, it is not possible to significantly attenuate the noise by simply surrounding the portion of the pile that extends above the sediment. For effective sound reduction, it is necessary to attenuate the upward traveling Mach cone that emanates from the sediment.

I. Double Shell Piles

A family of novel noise-attenuating piles are disclosed below wherein an inner tube or rod extends through a generally concentric outer tube that is attached to a driving shoe at the distal end of the pile. The inner tube is hammered to drive the pile into the sediment, and the outer tube is configured to not be hammered. For example, the upper end of the inner tube may extend above the upper end of the outer tube. The outer tube is thereby pulled into the ground by the shoe. The inner tube, which is hammered and therefore conducts the compression waves discussed above, is largely isolated from the water and sediment by the outer tube, and therefore the radial expansion wave caused by the hammering is largely shielded from the environment. The inner tube or rod essentially operates as a mandrel extending through the outer tube to the shoe.

Figure 3:
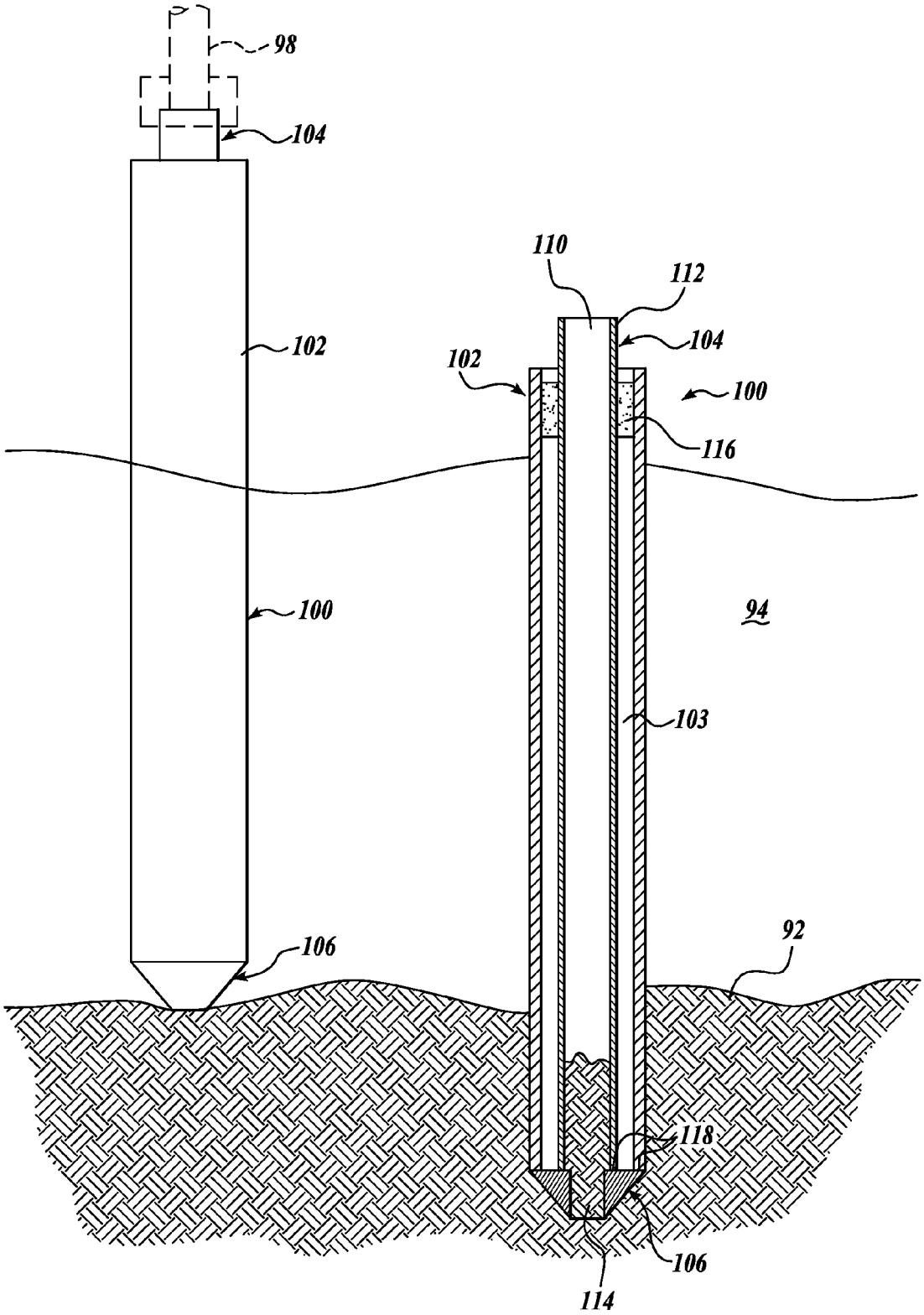
FIG. 3 illustrates two piles in accordance with the present invention, wherein one pile (on the left) is in position to be driven into an installed position, and the other pile (on the right) is shown installed and in cross section.

FIG. 3 illustrates a pair of noise-attenuating piles 100 in accordance with one aspect of the present invention. The noise-attenuating pile 100 on the left is shown in position to be driven into the desired position with a pile driver 98, which is schematically indicated in phantom at the top of the pile 100. The identical noise-attenuating pile 100 on the right in FIG. 3 is shown in cross section, and installed in the sediment 92.

The noise-attenuating pile 100 includes a structural outer tube 102, a generally concentric inner tube 104, and a tapered driving shoe 106. In a current embodiment, the outer tube 102 is sized and configured to accommodate the particular structural application for the pile 100, e.g., to correspond to a conventional pile. In one exemplary embodiment, the outer tube 102 is a steel pipe approximately 89 feet long and having an outside diameter of 36 inches and a one-inch thick wall. Of course, other dimensions and/or materials may be used and are contemplated by the present invention. The optimal size, material, and shape of the outer tube 102 will depend on the particular application. For example, hollow concrete piles are known in the art, and piles having non-circular, cross-sectional shapes are known. As discussed in more detail below, the outer tube 102 is not impacted by the driving hammer 90, and is pulled into the sediment 92 rather than being driven directly into the sediment. This aspect of the noise-attenuating pile 100 may facilitate the use of non-steel structural materials for the outer tube 102, such as reinforced concrete, fiber reinforced composite materials, carbon-fiber reinforced polymers, etc.

The inner tube 104 is generally concentric with the outer tube 102 and is sized to provide an annular space 103 between the outer tube 102 and the inner tube 104. The inner tube 104 may be formed from a material similar to the outer tube 102, for example, steel, or may be made of another material, such as concrete. It is also contemplated that the inner tube 104 may be formed as a solid elongate rod rather than being tubular. In a particular embodiment, the inner tube 104 comprises a steel pipe having an outside diameter of 24 inches and a ⅜-inch wall thickness, and the annular space 103 is about six inches thick.

In a particular embodiment, the outer tube 102 and the inner tube 104 are both formed of steel. The outer tube 102 is the primary structural element for the pile 100, and therefore the outer tube 102 may be thicker than the inner tube 104. The inner tube 104 is structurally designed to transmit the impact loads from the driving hammer 98 to the driving shoe 106.

The driving shoe 106 in this embodiment is a tapered annular member having a center aperture 114. The driving shoe 106 includes a frustoconical distal portion, with a wedge-shaped cross section tapering to a distal end defining a circular edge, to facilitate driving the pile 100 into the sediment 92. In a current embodiment, the driving shoe 106 is steel. The outer tube 102 and inner tube 104 are fixed to the proximal end of the driving shoe 106, for example, by welding 118 or the like. Other attachment mechanisms may alternatively be used; for example, the driving shoe 106 may be provided with a tubular post portion that extends into the inner tube 104 to provide a friction fit. The maximum outside diameter of the driving shoe 106 is approximately equal to the outside diameter of the outer tube 102, and the center aperture 114 is preferably slightly smaller than the diameter of the axial channel 110 defined by the inner tube 104. It will be appreciated that the center aperture 114 permits sediment to enter into the inner tube 104 when the pile 100 is driven into the sediment 92. The slightly smaller diameter of the driving shoe center aperture 114 will facilitate sediment entering the inner tube 104 by reducing wall friction effects within the inner tube 104.

It will be appreciated from FIG. 3 that the inner tube 104 is longer than the outer tube 102, such that a portion 112 of the inner tube 104 extends upwardly beyond the outer tube 102. This configuration facilitates the pile 98 engaging and impacting only the inner tube 104. It is contemplated that other means may be used to enable the pile driver 98 to impact the inner tube 104 without impacting the outer tube 102. For example, the pile driver 98 may be formed with an engagement end or an adaptor that fits within the outer tube 102. The important aspect is that the pile 100 is configured such that the pile driver 98 does not impact the outer tube 102, but rather impacts only the inner tube 104.

At or near the upper end of the pile 100, a compliant member 116, for example, an epoxy or elastomeric annular sleeve, may optionally be provided in the annular space 103 between the inner tube 104 and the outer tube 102. The compliant member 116 helps to maintain alignment between the tubes 102, 104, and may also provide an upper seal to the annular space 103. Although it is currently contemplated that the annular space 103 will be substantially air-filled, it is contemplated that a filler material may be provided in the annular space 103, for example, a spray-in foam or the like. The filler material may be desirable to prevent significant water from accumulating in the annular space 103, and/or may facilitate dampening the compression waves that travel through the inner tube 104 during installation of the pile 100.

The advantages of the construction of the pile 100 can now be appreciated with reference to the preceding analysis. As the inner tube 104 is impacted by the driver 98, a deformation wave propagates down the length of the inner tube 104 and is reflected when it reaches the driving shoe 106, to propagate back up the inner tube 104, as discussed above. The outer tube 102 portion of the pile 100 substantially isolates both the surrounding water 94 and the surrounding sediment 92 from the traveling Mach wave, thereby mitigating sound propagation into the environment. The outer tube 102, which in this embodiment is the primary structural member for the pile 100, is therefore pulled into the sediment by the driving shoe 106, rather than being driven into the sediment through driving hammer impacts on its upper end.

Figure 4:
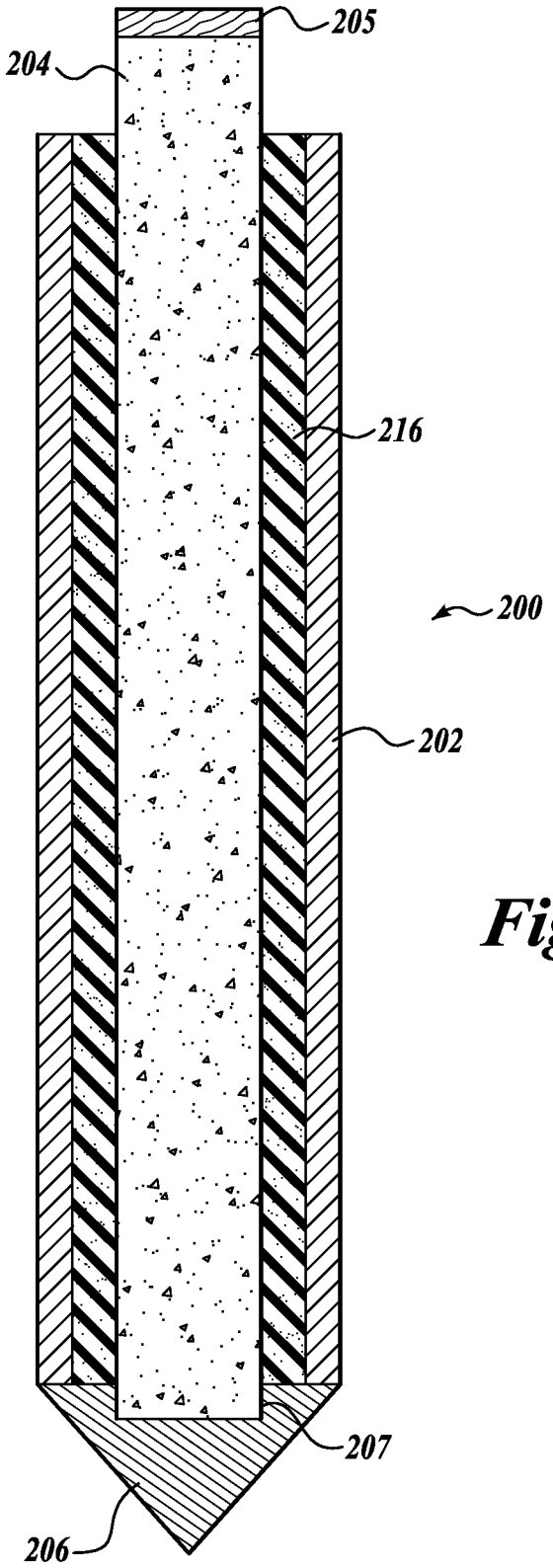
FIG. 4 shows another embodiment of a pile in accordance with the present invention.

A second embodiment of a noise-attenuating pile 200 in accordance with the present invention is shown in cross-sectional view in FIG. 4. In this embodiment, the pile 200 includes an outer tube 202, which may be substantially the same as the outer tube 102 discussed above. A solid inner member 204 extends generally concentrically with the outer tube 202, and is formed from concrete. For example, the concrete inner member 204 may be reinforced with steel cables (not shown). The inner member 204 may have a hexagonal horizontal cross section, for example. A tapered driving shoe 206 is disposed at the distal end of the pile 200, and is conical or frustoconical in shape, and may include a recess 207 that receives the inner member 204. In a currently preferred embodiment, the driving shoe 206 is made of steel. The outer tube 202 is attached to the driving shoe 206, for example, by welding or the like. The inner member 204, in this embodiment, extends above the proximal end of the outer tube 202. Although not a part of the pile 200, a wooden panel 205 is illustrated at the top of the inner member 204, which spreads the impact loads from the pile driver to protect the concrete inner member 204 from crumbling during the driving process. Optionally, in this embodiment, a filler 216 such as a polymeric foam substantially fills the annular volume between the outer tube 202 and the inner member 204.

It is contemplated that in an alternate similar embodiment, an outer tube may be formed of concrete, and an inner tube or solid member may be formed from steel or a similarly suitable material.

Figure 5:
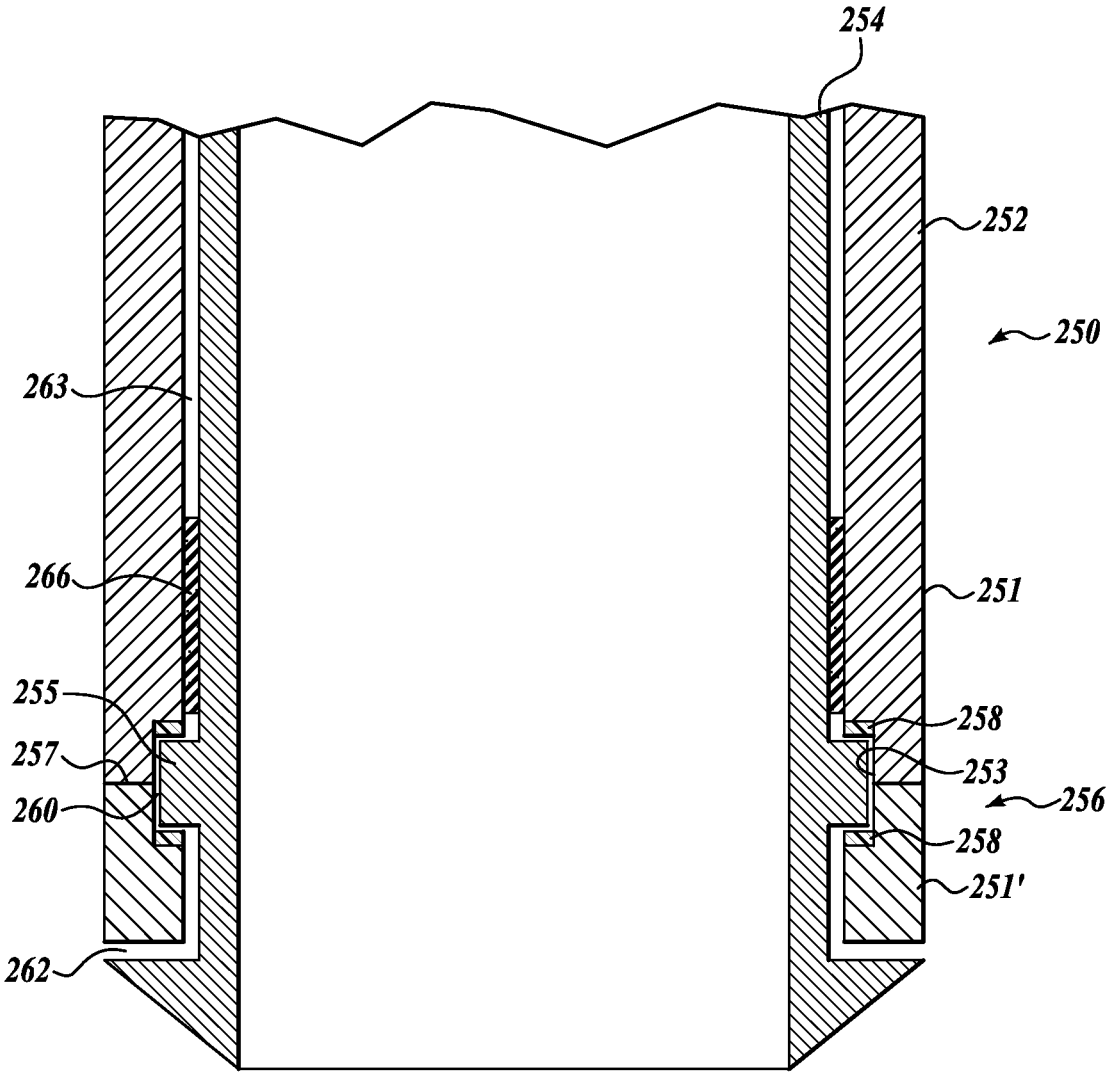
FIG. 5 shows a fragmentary view of the distal end of an embodiment of a pile in accordance with the present invention.

FIG. 5 shows a fragmentary cross-sectional view of a distal end of an alternative embodiment of a pile 250 having an inner tube 254 and an outer tube 252. The pile 250 is similar to the pile 100 disclosed above, but wherein the driver shoe 256 is formed integrally with the inner and outer tubes 254, 252. In this embodiment, the distal end portion of the inner tube 254 includes an outer projection or flange 255. For example, the flange 255 may be formed separately and welded or otherwise affixed to the distal end portion of the inner tube 254. The outer tube 252 is configured with a corresponding annular recess 253 on an inner surface, which is sized and positioned to retain or engage the flange 255. In an exemplary construction method, the outer tube 252 is formed from two pieces, an elongate upper piece 251 having an inner circumferential groove on its bottom end, and a distal piece 251' having a corresponding inner circumferential groove on its upper end. The distal piece 251' may further be formed in two segments to facilitate placement about the inner tube 254. The upper piece 251 and distal piece 251' may then be positioned about the inner tube 254 such that the flange 255 is captured in the annular recess 253, and the upper piece 251 and distal piece 251' welded 257 or otherwise fixed together. The inner tube 254 and outer tube 252 are therefore interlocked by the engagement of the inner tube flange 255 and the outer tube annular recess 253. One or two low-friction members 258 (two shown), for example, nylon, Teflon®, or ultra-high-molecular weight polyethylene washers, may optionally be provided.

In the embodiment of FIG. 5, the flange 255 is sized such that a gap 260 is formed between an outer surface of the flange 255 and an inner surface of the annular recess 253. Also, the length of the outer tube 252 is configured to provide a gap 262 between the bottom of the outer tube 253 and the horizontal surface of the shoe 256 near the distal end of the inner tube 254. It will now be appreciated that, as the radial displacement waves induced by the pile driver travel along the inner tube 254, the outer tube 252 will be further isolated from the radial displacement waves due to these gaps 260, 262. An annular space 163 between the inner tube 254 and the outer tube 252 in this embodiment may optionally be sealed with a sleeve 266, which may be formed with a polymeric foam or other sealing material as are known in the art.

Figure 6:
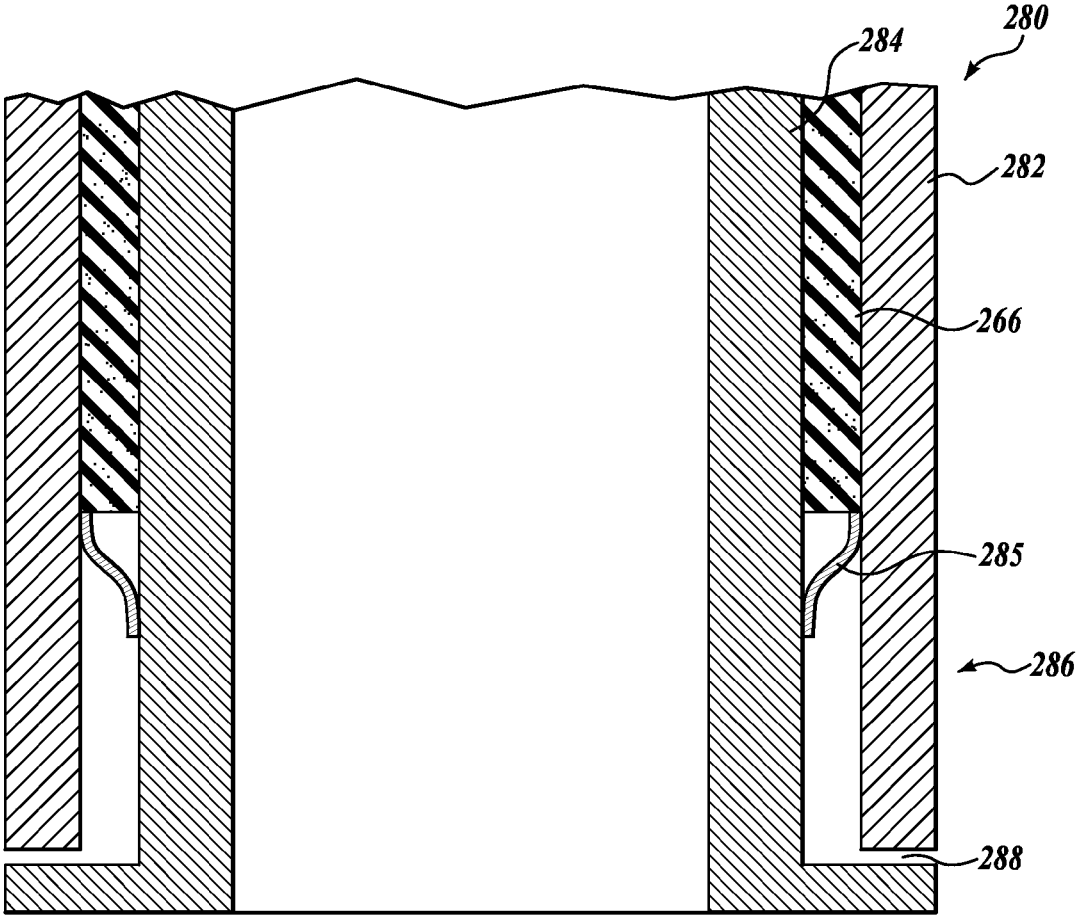
FIG. 6 illustrates an elastic connection mechanism that may alternatively be used to isolate the outer tube from the inner member in an alternative embodiment of a pile in accordance with the present invention.

Although a flange and recess connection is shown in FIG. 5, it is also contemplated, as illustrated in FIG. 6, that a pile 280 in accordance with the present invention may include an elastic or compliant connector 285 between the inner tube 284 and the outer tube 282 of the pile 280. The compliant connector 285 is preferably "soft" in the radial direction such that it does not transfer any significant energy from the inner tube 254 to the outer tube 252 from radial expansion. However, it may be relatively stiff in the axial direction, such that downward momentum is transferred from the inner tube 254 to the outer tube 252. It is contemplated, for example, that the elastic connector 285 connecting the inner tube and outer tube may be an annular linear elastic spring member with an inner edge fixed to the inner tube 284, and an outer edge fixed to the outer tube 282. In this embodiment, the driving shoe 286 is formed integrally with the inner and outer tubes 284, 282, and the elastic connector 285 substantially isolates the outer tube 282 from the radial compression waves induced in the inner tube 284 by the driver (not shown).

Although the piles are shown in a vertical orientation, it will be apparent to persons of skill in the art, and is contemplated by the present invention, that the piles may alternatively be driven into sediment at an angle.

II. Low Effective Poisson'S Ratio Piles

A conventional steel pile typically includes a metal tube that is fixed to a driving shoe, and driven or hammered into the ground. As discussed above and illustrated in FIGS. 1A-2, the hammer strikes that drive the pile into the sediment or other ground generates compression waves that travel along the length of the pile, generating corresponding compression waves in the sediment and water. The present inventors have discovered that, in a conventional pile, this compression wave becomes coupled with the ground or sediment as the pile is driven into the ground, and then travels upwardly through the ground in a Mach cone, thereby circumventing conventional means for attenuating the noise, such as bubble curtains and the like. With each hammer strike, a longitudinal displacement wave also produces a radial displacement motion in the pile, due to the Poisson effect.

When a conventional material is compressed, it tends to expand in the directions perpendicular to the direction of compression. This is called the Poisson effect, and Poisson's ratio quantifies the tendency of the material to expand. The Poisson effect has a physical interpretation: A cylindrical rod of isotropic elastic material will respond to an axial compression force by decreasing in length and increasing in radius. Poisson's ratio is defined, in the limit of a small compressive force, as the ratio of the relative change in radius to the relative change in length. Poisson's ratio of steel, for example, is typically about 0.26-0.31. Certain non-isotropic composite materials and metamaterials are known that have a Poisson's ratio that is near zero or even negative. A material having a negative Poisson's ratio is referred to as an auxetic material. See, for example, U.S. Pat. No. 6,878,320, which is hereby incorporated by reference.

Typically steel has a Poisson's ratio between about 0.27 and 0.3, and concrete has a Poisson's ratio of about 0.2. As used herein, "low-Poisson's ratio" is defined to be a Poisson's ratio less than 0.1. It is also possible to substantially reduce the radial amplitude caused by the compression (or tension) wave by reducing the effective Poisson's ratio of the pile. As used herein, a pile having an effective Poisson's ratio of zero is defined to mean a pile that does not expand radially in response to the axial compressions applied by the pile driver. Such a pile would substantially mitigate coupling the compression waves generated by the hammer with the surrounding sediment and water.

Figure 7:
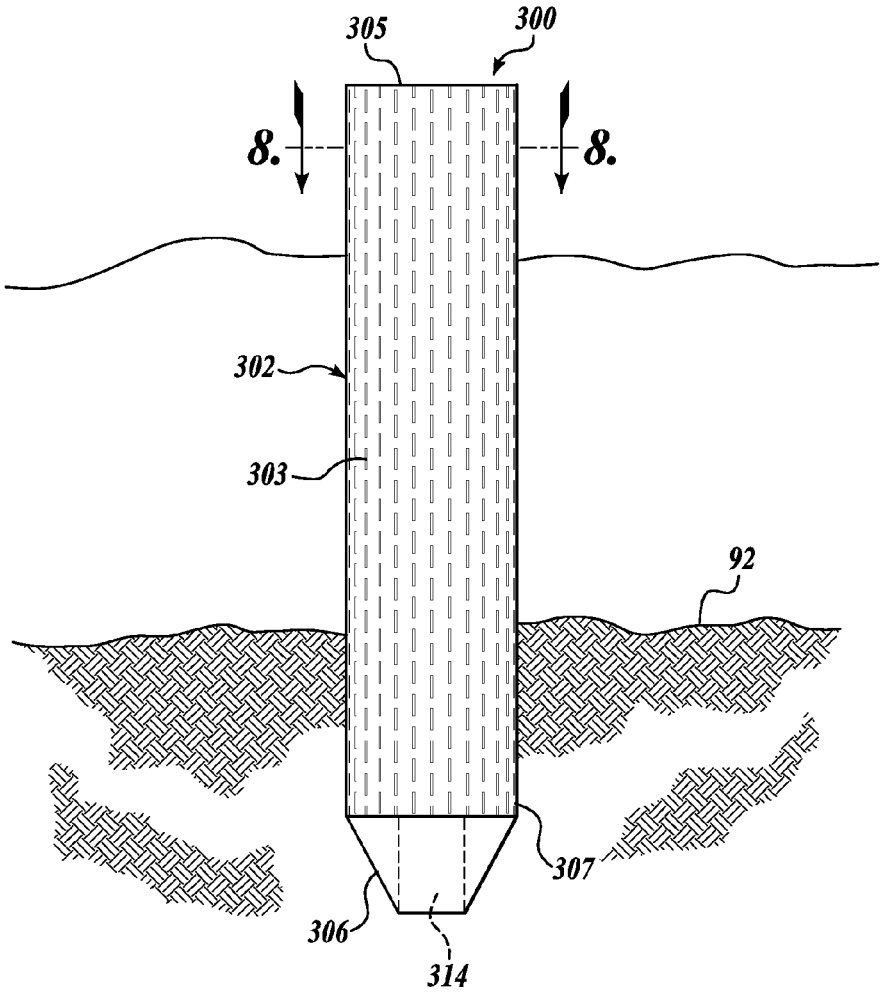
FIG. 7 illustrates another embodiment of a pile in accordance with the present invention, wherein the pile has a tubular portion with a plurality of slots that attenuate the radial amplitude of longitudinal compression waves.

A pile 300 with a low effective Poisson's ratio in accordance with another aspect of the present invention, and which attenuates radial compression waves, is illustrated in FIG. 7, shown partially driven into the sediment 92. The pile 300 includes a structural elongate tube 302, which may conventionally be substantially circular in cross-section, although other shapes are contemplated. A tapered driving shoe 306 with a center aperture 314 is fixed to a distal end 307 of the tube 302. In this embodiment, the tube 302 is constructed with a plurality of relatively short vertical slots 303, wherein the slots 303 are provided in columns along most of the length of the tube 302. The slots 303 of neighboring columns may be offset vertically. It will be appreciated that the pile 300 may be formed of a composite material having a low Poisson's ratio, as defined herein to further avoid or further attenuate compression waves in the pile 300. It is also contemplated that a low Poisson's ratio pile in accordance with the present invention and similar to the pile 300, but without the vertical slots 303, may be formed from a low Poisson's material.

Figure 8:
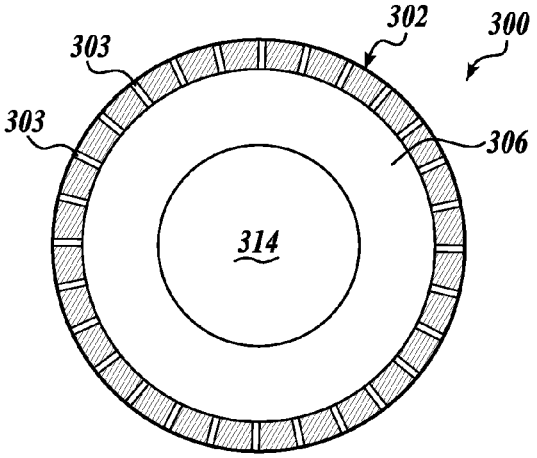
FIG. 8 is a cross-sectional view of the pile shown in FIG. 7.

A cross-sectional view of the pile 300 through section 8-8 is shown in FIG. 8. A compression wave formed by the pile driver hammer impacting the proximal end 305 of the tube 302 initially manifests as a radial bulge. As the radial bulge travels downwardly, it quickly encounter the geometry change defined by the first row of slots 303. The tube 302 material can now expand circumferentially (e.g., towards closing the slot 303), thereby substantially reducing the radial expansion of the tube 302 material. The compression/tension wave continues traveling down the tube 302 and encounters the geometry change resulting from the second offset row of slots 303. The pile material again expands circumferentially into the slots 303, thereby causing minimal radial deflection. Therefore, the radial compression wave will be minimal as the compression/tension wave travels vertically along the length of the tube 302.

Although the slots 303 are illustrated as vertically aligned and with neighboring columns vertically offset, this particular arrangement is not intended to be restrictive, and other suitable configurations will be apparent to persons of skill in the art. For example, it is contemplated that the slots 303 may not be arranged in vertically aligned columns, and a less regular arrangement may be preferable. It may be preferred to circumferentially offset each row of slots 303 by a small amount to further disrupt the ability for the radial component of the compression wave to travel vertically along the length of the tube 302. It is also contemplated that the slots 303 may alternatively be arranged at an angle and/or with some curvature.

Figure 9A:
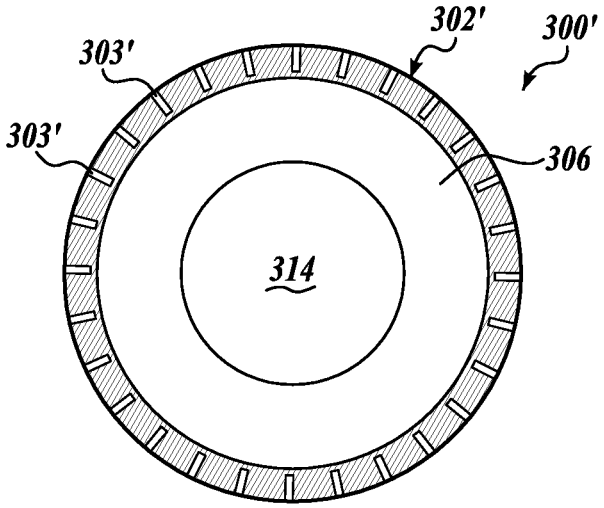
FIGS. 9A and 9B illustrate alternative cross-sections for the pile shown in FIG. 7.
Figure 9B:
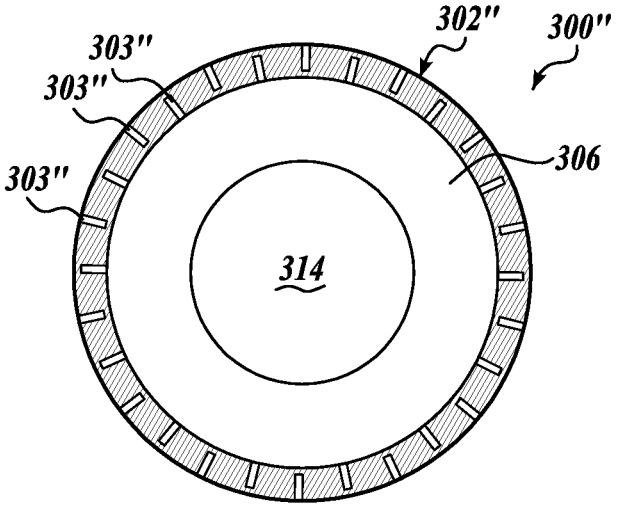

FIGS. 9A and 9B illustrate alternative exemplary cross-sectional geometries of piles 300', 300" for elongate tube 302', 302". In particular, in FIG. 9A, the slots or grooves 303' extend only partially through the wall of the tube 302', and are formed in the outer surface. In FIG. 9B, the slots 303" extend only partially through the wall defining the tube 302", and alternate between being formed on the inner surface and the outer surface. Other options will be apparent to persons of skill in the art, for example, the grooves may be provided only on the inner surface.

Figure 10:
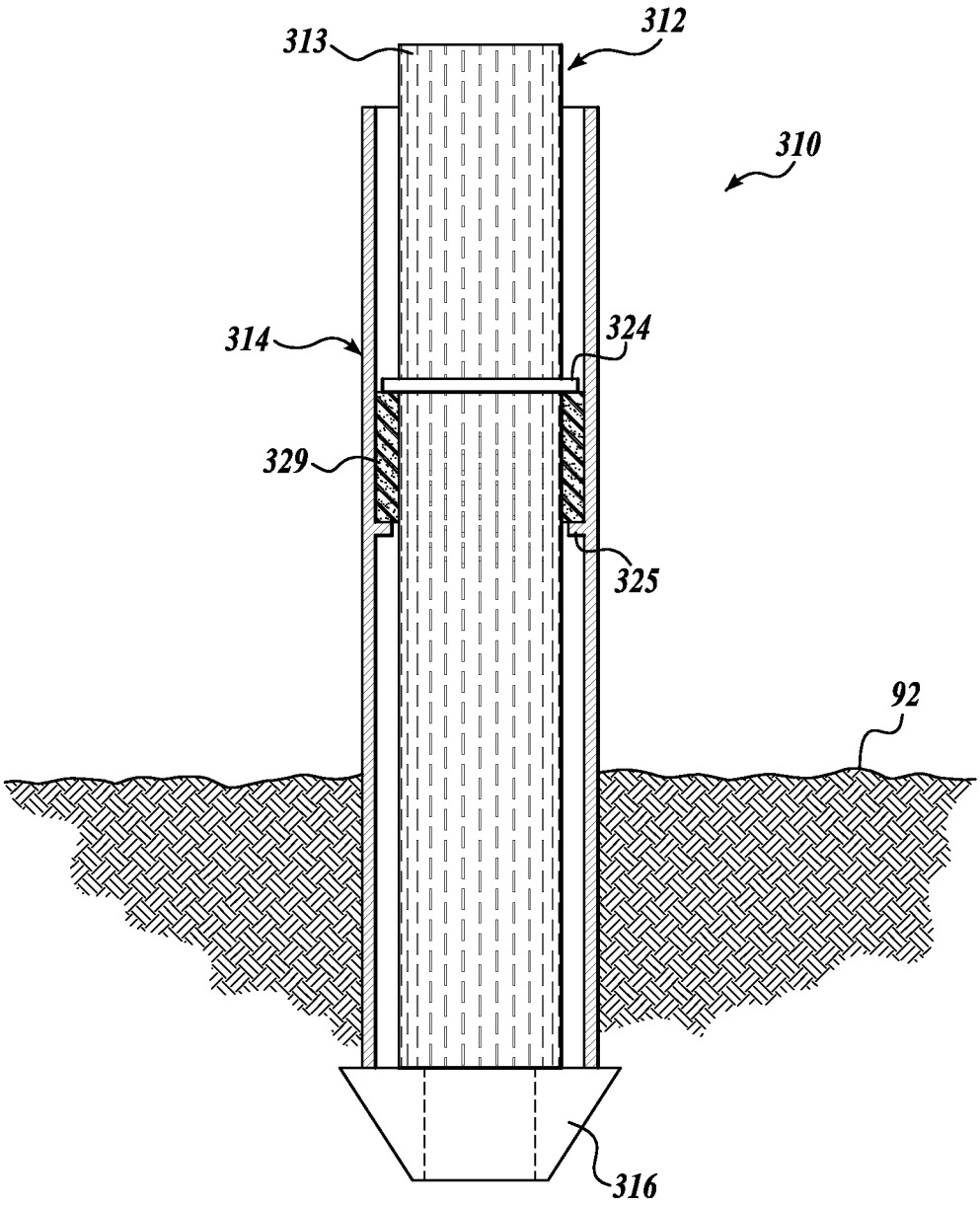
FIG. 10 is a partial cross-sectional view of another embodiment of a pile in accordance with the present invention wherein the pile comprises an outer tubular member and an inner mandrel or tubular member with geometric features to attenuate the radial amplitude of longitudinal compression waves, and further includes a larger-diameter driving shoe.

FIG. 10 illustrates another embodiment of pile 310 having a low or near-zero effective Poisson's ratio. The inner tube 312 in this embodiment is similar to the tube 302 discussed above and with a plurality of longitudinal slots 313. An outer tube 314 is fixed to the driving shoe 316, thereby defining a double-shell pile 310. The inner tube 312 may be designed to abut the driving shoe 316 without permanently attaching the inner tube 312 to the outer tube 314. The inner tube 312 may therefore be configured to be inserted through the outer tube 312 and used for driving the pile 310 into place, and then removed and reused, e.g., such that the inner tube 312 functions as a mandrel. It is preferable, if water has accumulated, that the annular volume between the inner tube 312 and the outer tube 314 be cleared of water prior to driving the pile 310. The outer tube 314 is fixedly attached to the driving shoe 316, and is therefore pulled into the ground by the driving shoe 316. In the double-shell pile 310, it is contemplated that the outer tube 314 may also have an effective low Poisson's ratio, for example, by providing longitudinal slots or grooves, or forming the outer tube 314 from a composite material having a low Poisson's ratio. In this embodiment, a compressible polymeric foam sleeve 317 is provided between the inner tube 312 and the outer tube 314, which provides flexibility in both the longitudinal and radial directions.

Another novel aspect of the pile 310 is the enlarged-diameter driving shoe 316, which extends radially beyond the diameter of the outer tube 314. It will be appreciated that when a conventional pile is driven into the sediment, it becomes increasingly difficult to drive the pile due to forces exerted by the sediment 92 on the pile. In particular, as the pile is driven into the sediment 92, the sediment bed behaves in part elastically, and sediment 92 is urged or pressed inwardly by elastic forces in the media, applying a clamping-like force to the pile. The deeper the conventional pile is driven in, the greater the frictional forces exerted by the sediment 92 on the pile.

The pile 310 shown in FIG. 10 has a driving shoe 316 that extends outwardly a distance beyond the outside perimeter of the outer tube 314. This larger-diameter shoe reduces the frictional forces between the outer tube 314 and the sediment 92. For example, the driving shoe 316 may extend radially one-half inch to three inches beyond the outer tube 314. The sediment 92 is therefore initially displaced beyond the radius of the outer tube 314. As the sediment relaxes after passage of the driving shoe 316, the elastic forces on the outer tube 314 will be reduced. The larger diameter driving shoe 316 is particularly advantageous in piles such as that shown in FIG. 10, wherein an internal mandrel or inner tube 312 is used to urge the driving shoe 316 into the sediment 92, and the outer tube 314 is pulled by the driving shoe 316.

In this embodiment, the inner tube 312 further includes an upper flange 324 that extends radially outwardly without engaging the outer tube 314, and the outer tube 314 includes a lower flange 325 that extends radially inwardly without engaging the inner tube 312. A filler material or sleeve 329 is disposed between the upper flange 324 and the lower flange 325. The sleeve 329 may be formed from a material having variable or non-liner stiffness properties. In this embodiment, the sleeve 329 and flanges 324, 325 may permit a design amount of compression of the inner tube 312 with relatively lower axial coupling with the outer tube 314. As the sleeve 329 compresses further the axial coupling between the tubes 312, 314 will increase.

It is contemplated that in some embodiments the inner tube 312 or the outer tube 314, or portions thereof, may be removable during any point of the installation process.

Figure 11:
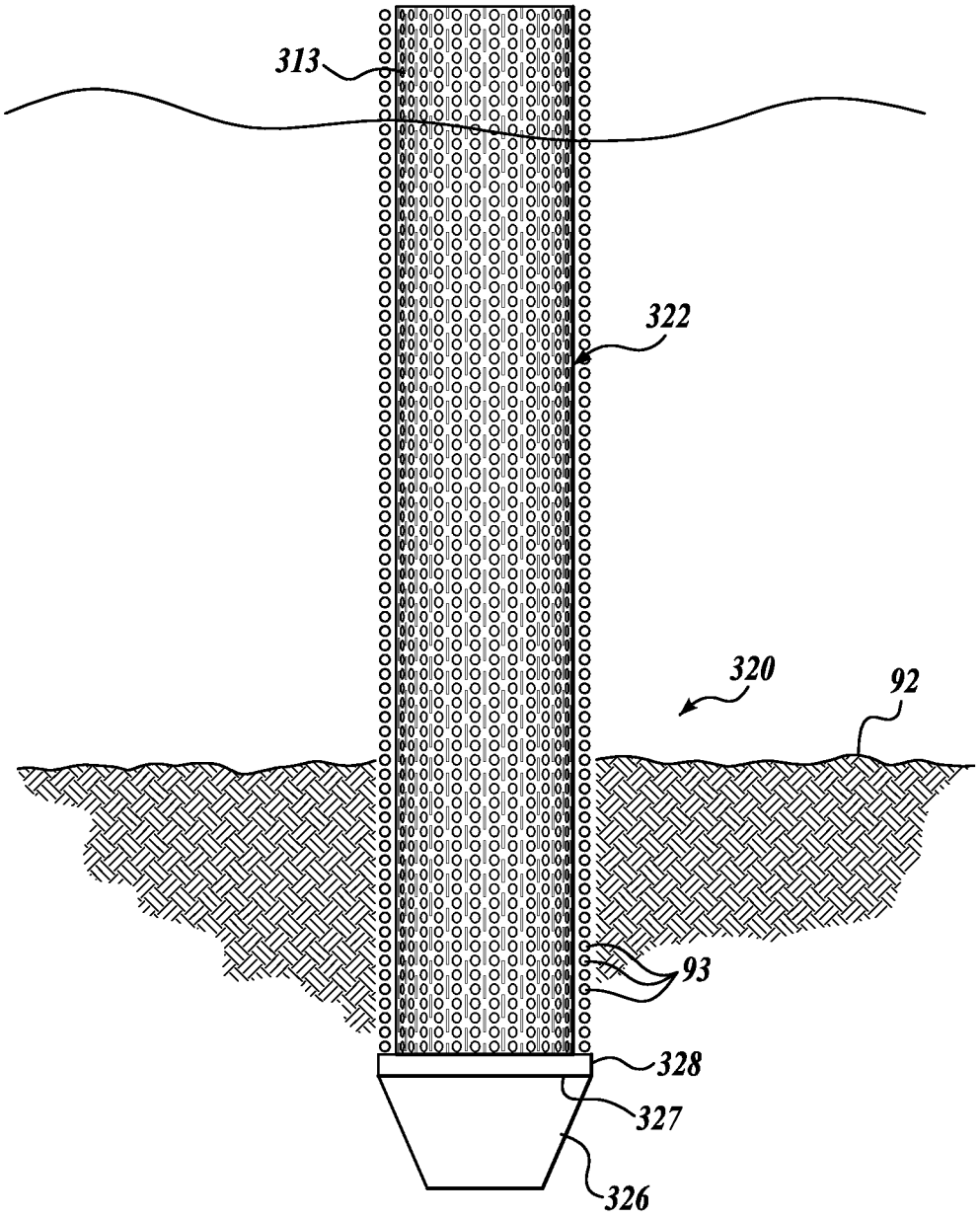
FIG. 11 illustrates another embodiment of a pile in accordance with the present invention, further including a bubble generator disposed near the base of the pile.

Another embodiment of a pile 320 in accordance with the present invention is shown in FIG. 11. This embodiment is similar to the pile 300 shown in FIG. 7 with the larger diameter driving shoe 316 shown in FIG. 10. However, in this embodiment, a bubble generator or plenum 328 is provided on the ledge 327 defined by the portion of the driving shoe 326 that extends beyond the outer perimeter of the tube 322. As discussed above, bubble generators for forming bubble curtains are known in the art. However, typically the bubble curtains are disposed a distance away from the piles and are generated from the sediment floor. Prior art bubble curtains are intended to reduce the transmission of pressure waves generated by the pile driving through the water.

In the pile 320, the bubbles 93 are generated from the plenum 328 near or adjacent the outer perimeter of the pile tube 322 and attached to the driving shoe 326. Therefore, the bubbles 93 are generated from below the sediment floor 92 and extend further into the sediment 92 as the pile 320 is driven in. The bubble plenum 328 receives high pressure air from a source (not shown). The bubbles 93 therefore provide some noise abatement, and importantly aid in reducing the friction between the pile tube 322 and the sediment 92. By reducing the friction, the bubbles 93 also advantageously reduce the shear waves transmitted into the sediment 92, which is particularly important when pile driving on land close to buildings.

In exemplary embodiments, the slots 303, 303', 303" have a length in the range of three to twenty-four inches, and a width in the range of one-sixteenth to one-half inch. The circumferential or angular spacing of the slots may be in the range of a few degrees to sixty degrees. In a particular embodiment, the slots 303 are about eighteen inches long and one-eighth inch wide. The tube 302 is one-inch thick steel with a circumference of 36 inches, and slots 303 are provided every five degrees. In another exemplary embodiment, the slots 303 are only provided along a portion of the length of the tube 302, for example, along the upper or lower half of the tube 302. Although slots or grooves are currently preferred for attenuating the radial amplitude of the compression waves, it is contemplated that other means for allowing and encouraging circumferential expansion may be used. For example, elongate features similar to the slots or grooves described above may be accomplished by heat treating longitudinal sections of the tube, such that relatively "soft" elongate features permit circumferential expansion. Similarly, non-homogeneous material properties may be achieved by forming the tube with different materials, for example, including elongate longitudinal portions comprising a softer or more compressible material.

Other mechanisms for reducing the effective Poisson's ratio, i.e., reduce the radial expansion in the pile, are contemplated. For example, the pile may be wound by a tension cable on the outside.

While illustrative embodiments have been illustrated and described, it will be appreciated that various changes can be made therein without departing from the spirit and scope of the invention.

The embodiments of the invention in which an exclusive property or privilege is claimed are defined as follows:

1. A pile configured for noise abatement during installation comprising:

a driving shoe;

an elongate first tube having a distal end that engages the driving shoe and a proximal end configured to be driven with a pile driver, wherein the elongate first tube further comprises a plurality of geometric features configured to attenuate the radial amplitude of traveling compression waves by providing a space for circumferential expansion in the elongate first tube;

wherein the geometric features comprise a plurality of slots extending at least partially through the elongate first tube;

wherein the plurality of slots are aligned with a longitudinal axis of the elongate first tube; and further comprising an elongate second tube that is attached to the driving shoe and is disposed radially outwardly from the elongate first tube; and wherein the elongate first tube is configured to be removed after driving the pile.

2. A method for driving piles into ground comprising:

providing a pile having a driving shoe, and an elongate first tube having a distal end that engages the driving shoe and a proximal end configured to be driven with a pile driver, wherein the elongate first tube further comprises a plurality of geometric features configured to attenuate the radial amplitude of traveling compression waves by providing a space for circumferential expansion in the elongate first tube, wherein the geometric features comprise a plurality of grooves extending only partially through the elongate first tube, and are disposed on an inner surface of the elongate first tube or on an outer surface of the elongate first tube;

providing an elongate second tube that is attached to the driving shoe and is disposed radially outwardly from the elongate first tube;

positioning the pile at a desired position with the driving shoe contacting the ground;

driving the pile with a pile driver; and removing the elongate first tube after driving the pile.

3. A pile configured for noise abatement during installation comprising:

a driving shoe; and an elongate first tube having a distal end that engages the driving shoe and a proximal end configured to be driven with a pile driver, wherein the elongate first tube is formed from a composite material having a Poisson's ratio of less than 0.1.

4. The pile of claim 3, wherein the composite material comprises one of a fiber reinforced composite, a reinforced concrete, and a carbon-fiber reinforced polymer.

5. The pile of claim 3, wherein the elongate tube further comprises plurality of slots that are aligned with a longitudinal axis of the elongate first tube.

6. The pile of claim 5, wherein the plurality of slots are disposed in columns, and further wherein neighboring columns of slots are longitudinally offset.

7. The pile of claim 5, wherein the plurality of slots extend only partially through the elongate first tube.

8. The pile of claim 3, further comprising an elongate second tube that is attached to the driving shoe and is disposed radially outwardly from the elongate first tube.

9. The pile of claim 8, wherein the elongate first tube is configured to be removed after driving the pile.

10. The pile of claim 8, wherein the driving shoe is tapered with a wide end that engages the distal end of the elongate first tube, and further wherein the wide end of the driving shoe extends radially beyond the elongate first tube to define a ledge portion.

11. The pile of claim 10, further comprising a plenum having a plurality of apertures and configured to be connected with a pressurized gas source to produce bubbles, wherein the plenum is attached to the ledge portion of the driving shoe.

12. The pile of claim 3, wherein the pile is formed from an auxetic material.

13. A pile configured for noise abatement during installation comprising:

a driving shoe;

an elongate first tube having a distal end that engages the driving shoe and a proximal end configured to be driven with a pile driver, wherein the elongate first tube further comprises a plurality of geometric features configured to attenuate the radial amplitude of traveling compression waves by providing a space for circumferential expansion in the elongate first tube;

wherein the geometric features comprise a plurality of slots extending at least partially through the elongate first tube;

wherein the plurality of slots are aligned with a longitudinal axis of the elongate first tube;

wherein the elongate first tube is a circular tube having a first diameter;

wherein the driving shoe is tapered with a wide end that engages the distal end of the elongate first tube, and further wherein the wide end of the driving shoe extends radially beyond the elongate first tube to define a ledge portion; and further comprising a plenum having a plurality of apertures and configured to be connected with a pressurized gas source to produce bubbles, wherein the plenum is attached to the ledge portion of the driving shoe and configured to generate a bubble curtain around a portion of the first tube.

14. A method for driving piles into ground comprising:

providing a pile having a driving shoe, and an elongate first tube having a distal end that engages the driving shoe and a proximal end configured to be driven with a pile driver, wherein the elongate first tube further comprises a plurality of geometric features configured to attenuate the radial amplitude of traveling compression waves by providing a space for circumferential expansion in the elongate first tube;

positioning the pile at a desired position with the driving shoe contacting the ground; and driving the pile with a pile driver;

wherein the elongate first tube is a circular tube having a first diameter, and the driving shoe has an outer diameter greater than the first diameter; and further wherein the driving shoe defines a ledge extending radially beyond the elongate first tube, and further comprising attaching a plenum having a plurality of apertures to the ledge, and connecting the plenum to a source of pressurized air, and generating a bubble curtain around a portion of the first tube.

* * * * *